US006060718A

United States Patent [19]

Brailove et al.

[11] Patent Number: 6,060,718

[45] Date of Patent: May 9, 2000

[54] ION SOURCE HAVING WIDE OUTPUT CURRENT OPERATING RANGE

[75] Inventors: Adam A. Brailove, Gloucester, Mass.; Masateru Sato, SaijŌ , Japan

[73] Assignee: Eaton Corporation, Cleveland, Ohio

[21] Appl. No.: 09/031,423

[22] Filed: Feb. 26, 1998

[51] Int. Cl.[7] ..... H01J 27/00

[52] U.S. Cl. ..... 250/505.1; 250/423 R

[58] Field of Search ..... 250/423 R, 492.21, 250/505.1

[56] References Cited

U.S. PATENT DOCUMENTS

| | | | |
|---|---|---|---|
| 3,187,179 | 6/1965 | Craig et al. | 250/423 R |
| 3,742,275 | 6/1973 | Gutow | 250/423 R |
| 4,207,489 | 6/1980 | Camplan et al. | 250/505.1 |
| 4,447,732 | 5/1984 | Leung et al. | 250/427 |
| 4,486,665 | 12/1984 | Leung et al. | 250/427 |
| 5,063,034 | 11/1991 | Kawanami et al. | 250/505.1 |
| 5,063,294 | 11/1991 | Kawata et al. | 250/505.1 |
| 5,166,531 | 11/1992 | Huntzinger | 250/505.1 |

FOREIGN PATENT DOCUMENTS 8-209341 8/1996 Japan .

OTHER PUBLICATIONS

K. W. Ehlers and K. N. Leung (Effect of a magnetic filter on hydrogen ion species in a multicusp ion source) Jun. 17, 1981.

K. W. Ehlers and K. N. Leung (Further study on a magnetically filtered multicusp ion source) May 18, 1982.

*Primary Examiner*—Bruce C. Anderson
*Attorney, Agent, or Firm*—John A. Kastelic

[57] ABSTRACT

An attenuator (90) for an ion source (26) is provided. The ion source comprises a plasma chamber (76) in which a gas is ionized by an exciter (78) to create a plasma which is extractable through at least one aperture (64) in an apertured portion (50) of the chamber to form an ion beam. The attenuator (90) comprises a member (90) positioned within the chamber (76) intermediate the exciter (78) and the at least one aperture (64), the member providing at least one first opening (97) corresponding the at least one aperture (64), and being moveable between first and second positions with respect to the at least one aperture. In one embodiment, in the first position, the member is positioned adjacent the aperture (64) to obstruct at least a portion of the aperture, and in the second position the member is positioned away from the aperture (64) so as not to obstruct the aperture. In a second embodiment, the aperture (64) resides in an aperture plate (50) and (i) the member and the aperture plate form a generally closed region (102) between the aperture plate and the chamber (76) when the member is in the first position, and (ii) the aperture (64) is in direct communication with the chamber (76) when the member is in the second position. In this second embodiment, plasma within the chamber (76) diffuses through the region (102) before being extracted through the aperture in the first position, and plasma within the chamber is extracted directly through the aperture in the second position.

18 Claims, 8 Drawing Sheets

ION SOURCE HAVING WIDE OUTPUT CURRENT OPERATING RANGE

FIELD OF THE INVENTION

The present invention relates generally to ion sources for ion implantation equipment and more specifically to an ion source having a wide output current operating range.

BACKGROUND OF THE INVENTION

Ion implantation has become a standard accepted technology of industry to dope workpieces such as silicon wafers or glass substrates with impurities in the large scale manufacture of items such as integrated circuits and flat panel displays. Conventional ion implantation systems include an ion source that ionizes a desired dopant element which is then accelerated to form an ion beam of prescribed energy. The ion beam is directed at the surface of the workpiece to implant the workpiece with the dopant element. The energetic ions of the ion beam penetrate the surface of the workpiece so that they are embedded into the crystalline lattice of the workpiece material to form a region of desired conductivity. The implantation process is typically performed in a high vacuum process chamber which prevents dispersion of the ion beam by collisions with residual gas molecules and which minimizes the risk of contamination of the workpiece by airborne particulates.

Conventional ion sources consist of a chamber, usually formed from graphite, having an inlet aperture for introducing a gas to be ionized into a plasma and an exit aperture through which the plasma is extracted to form the ion beam. The gas is ionized by a source of excitation such as a resistive filament or a radio frequency (RF) antenna located within or proximate the chamber. The plasma density, and hence the output current of the extracted ion beam, may be increased by increasing the power applied to the source of excitation.

Increasing the input power applied to the excitation source, however, affects beam characteristics other than beam current. For example, input power is one factor which determines the relative amounts of various atomic and molecular species that constitute the plasma. Accordingly, this characteristic is closely coupled to the beam current and the two cannot be varied independently. Thus, with known ion sources, varying the beam current, which is necessary to determine the precise amount of dosage for a particular implant process, is not possible without altering the plasma constituency.

Some ion implantation systems include mass analysis mechanisms such as beam line magnets that remove undesirable atomic and molecular species from the beam which is subsequently transported to the workpiece. In such systems, the mass analysis mechanism can compensate for variances introduced into the beam constituency as a result of changes made to the beam current. Thus, altering the beam current does not present a significant problem.

In ion implantation systems where no mass analysis occurs, however, the problem of variable beam constituency remains. For example, in applications for implanting large surface areas, such as flat panel displays, a ribbon beam ion source is often utilized. An example of such an ion source is shown in U.S. Ser. No. 08/756,970 and U.S. Pat. No. 4,447,732. A plurality of exit apertures provides the capability for adjusting the width of the ribbon beam. Each of the plurality of exit apertures outputs a portion of the total ion beam output by the ion source. Beam portions output by apertures located between surrounding apertures overlap the beam portions output by those surrounding apertures. However, in such a ribbon beam system, no mass analysis of the ion beam is performed.

Accordingly, it is an object of the present invention to provide an ion source in which the output beam current may be altered independently of the beam constituency.

It is a further object of the present invention to provide such an ion source for use in ion implantation systems that do not include mass analysis mechanisms.

It is still a further object of the present invention to provide a mechanism for an ion source which provides a wide operating range of output begin currents, while maintaining the constituency of the plasma generated within the source.

SUMMARY OF THE INVENTION

An attenuator for an ion source is provided. The ion source comprises a plasma chamber in which a gas is ionized by an exciter to create a plasma which is extractable through at least one aperture in an apertured portion of the chamber to form an ion beam. The attenuator comprises a member positioned within the chamber intermediate the exciter and the at least one aperture, the member providing at least one first opening corresponding the at least one aperture, and being moveable between first and second positions with respect to the at least one aperture.

In one embodiment, in the first position the member is positioned adjacent the aperture to obstruct at least a portion of the aperture, and in the second position the member is positioned away from the aperture so as not to obstruct the aperture. In a second embodiment, the aperture resides in an aperture plate and (i) the member and the aperture plate form a generally closed region between the aperture plate and the chamber when the member is in the first position, and (ii) the aperture is in direct communication with the chamber when the member is in the second position. In this second embodiment, plasma within the chamber diffuses through the generally closed region before being extracted through the aperture in the first position, and plasma within the chamber is extracted directly through the aperture in the second position.

DETAILED DESCRIPTION OF A PREFERRED EMBODIMENT OF THE INVENTION

Figure 1:
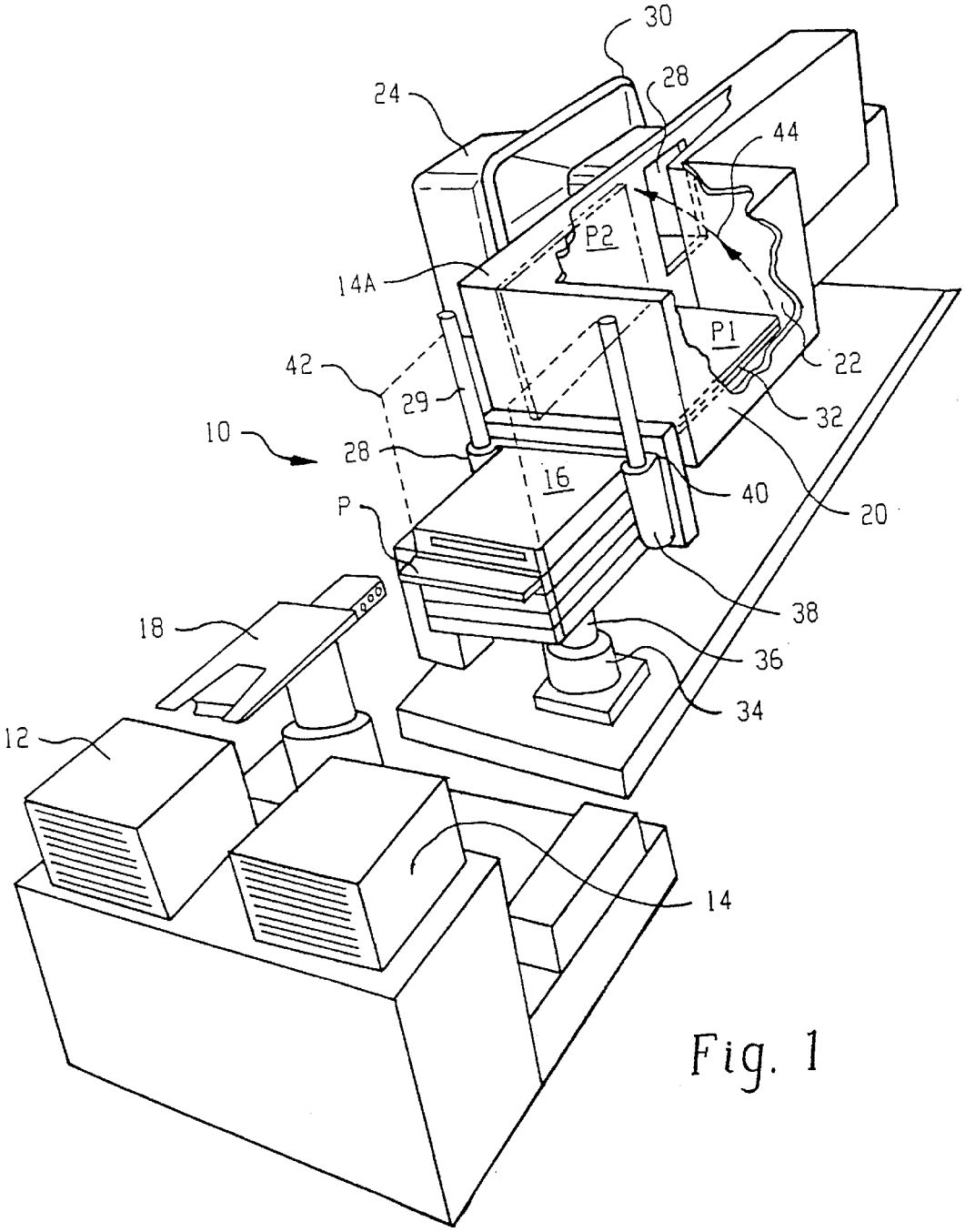
FIG. 1 is a perspective view of an ion implantation system into which an ion source constructed according to the principles of the present invention is incorporated.

Referring now to the drawings, FIG. 1 shows an ion implantation system 10 into which the inventive ion source magnetic filter is incorporated. The implantation system 10 shown is used to implant large area substrates such as flat display panels P.

The system 10 comprises a pair of panel cassettes 12 and 14, a load lock assembly 16, a robot or end effector 18 for transferring panels between the load lock assembly and the panel cassettes, a process chamber housing 20 providing a process chamber 22, and an ion source housing 24 providing an ion source 26 (see FIGS. 2–6). Panels are serially processed in the process chamber 22 by an ion beam emanating from the ion source which passes through an opening 28 in the process chamber housing 20. Insulative bushing 30 electrically insulates the process chamber housing 20 and the ion source housing 24 from each other.

A panel P is processed by the system 10 as follows. The end effector 18 removes a panel to be processed from cassette 12, rotates it 180°, and installs the removed panel into a selected location in the load lock assembly 16. The load lock assembly 16 provides a plurality of locations into which panels may be installed. The process chamber 22 is provided with a translation assembly that includes a pickup arm 32 which is similar in design to the end effector 18.

Because the pickup arm 32 removes panels from the same position, the load lock assembly is movable in a vertical direction to position a selected panel, contained in any of its plurality of storage locations, with respect to the pickup arm. For this purpose, a motor 34 drives a leadscrew 36 to vertically move the load lock assembly. Linear bearings 38 provided on the load lock assembly slide along fixed cylindrical shafts 40 to insure proper positioning of the load lock assembly 16 with the process chamber housing 20. Dashed lines 42 indicate the uppermost vertical position that the loadlock assembly 16 assumes, as when the pickup arm 32 removes a panel from the lowermost position in the loadlock assembly. A sliding vacuum seal arrangement (not shown) is provided between the loadlock assembly 16 and the process chamber housing 20 to maintain vacuum conditions in both devices during and between vertical movements of the loadlock assembly.

The pickup arm 32 removes a panel P from the loadlock assembly 16 in a horizontal position P1 (i.e. the same relative position as when the panel resides in the cassettes 12 and 14 and when the panel is being handled by the end effector 18). The pickup arm 32 then moves the panel from this horizontal position P1 in the direction of arrow 44 to a vertical position P2 as shown by the dashed lines in FIG. 1. The translation assembly then moves the vertically positioned panel in a scanning direction, from left to right in FIG. 1, across the path of an ion beam generated by the ion source and emerging from the opening 28.

The ion source outputs a ribbon beam. The term "ribbon beam" as used herein shall mean an elongated ion beam having a length that extends along an elongation axis and having a width that is substantially less than the length and that extends along an axis which is orthogonal to the elongation axis. The term "orthogonal" as used herein shall mean substantially perpendicular. Ribbon beams have proven to be effective in implanting large surface area workpieces in part because they simplify the mechanical handling of the workpiece. For example, prior art techniques required that the ion beam be scanned in two orthogonal directions over the workpiece in order to implant the entire workpiece. In comparison, when a ribbon beam is used having a length that exceeds at least one dimension of the workpiece, only one scan of the workpiece is required to implant the entire workpiece.

In the system of FIG. 1, the ribbon beam has a length that exceeds at least the smaller dimension of a flat panel being processed. The use of such a ribbon beam in conjunction with the ion implantation system of FIG. 1 provides for several advantages in addition to providing the capability of a single scan complete implant. For example, the ribbon beam ion source provides the ability to process panel sizes of different dimensions using the same source within the same system, and permits a uniform implant dosage by controlling the scan velocity of the panel in response to the sampled ion beam current.

Figure 2:
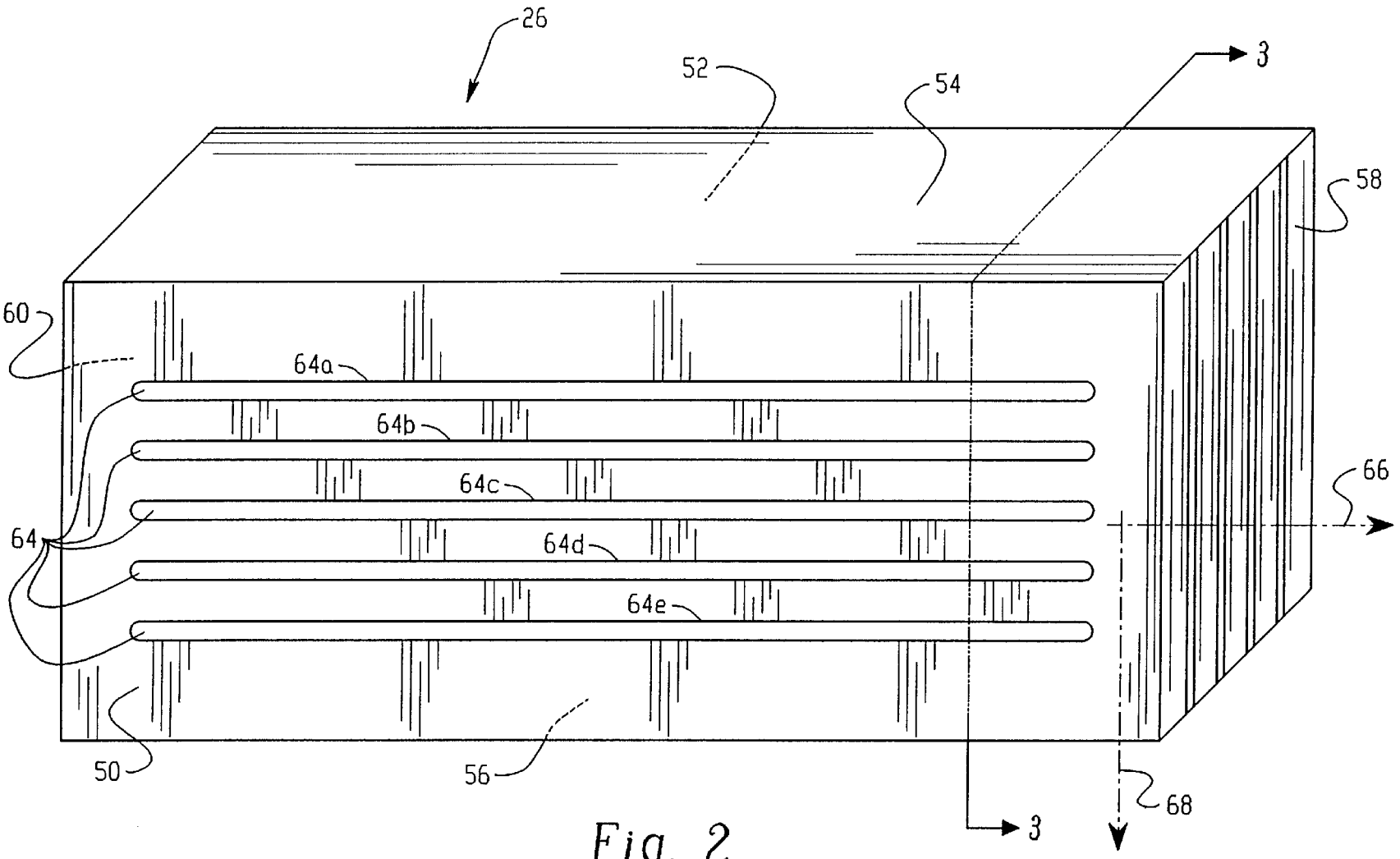
FIG. 2 is a perspective view of an ion source constructed according to the principles of the present invention.

FIGS. 2–6 show the ion source 26 in more detail. FIG. 2 provides a perspective view of the ion source 26 residing within the ion source housing 24 of FIG. 1. As shown in FIG. 2, the ion source 26 generally assumes the shape of a parallelepiped, having a front wall member or plasma electrode 50, a back wall 52, a top wall 54, a bottom wall 56, and side walls 58 and 60, respectively. From the perspective view provided by FIG. 2, back wall 52, bottom wall 56, and side wall 60 are hidden from view. The walls have exterior surfaces (visible in FIG. 2) and interior surfaces (not shown in FIG. 2) which together form a plasma confinement chamber 76 (see FIG. 3). The walls of the ion source 26 are comprised of aluminum or other suitable material, and may be lined with graphite or other suitable material.

A plurality of elongated apertures 64 are provided in the plasma electrode 50 of the ion source 26. In the illustrated embodiment, five such apertures **64*a*–64*e* are shown, oriented parallel to each other. Each aperture outputs a portion of the total ion beam output by the source 26**. Beam portions output by apertures located between surrounding apertures (i.e. the middle aperture) overlap the beam portions output by those surrounding apertures (i.e. outer apertures). Accordingly, the width of the ion beam output by the ion source may be adjusted by selecting the number and configuration of apertures.

Each of the elongated apertures 64 has a high aspect ratio, that is, the length of the aperture or slot along a longitudinal axis 66 greatly exceeds the width of the aperture along an orthogonal axis 68 (perpendicular to axis 66). Both axes 66 and 68 lie in the same plane as plasma electrode 50 and, hence, the same plane as the elongated apertures 64. Generally, the length of the aperture (along axis 66) is at least fifty times the width of the aperture (along axis 68). Such a high aspect ratio (e.g. in excess of 50:1) forms a ribbon ion beam, which is particularly suitable for implanting large surface area workpieces.

Figure 3:
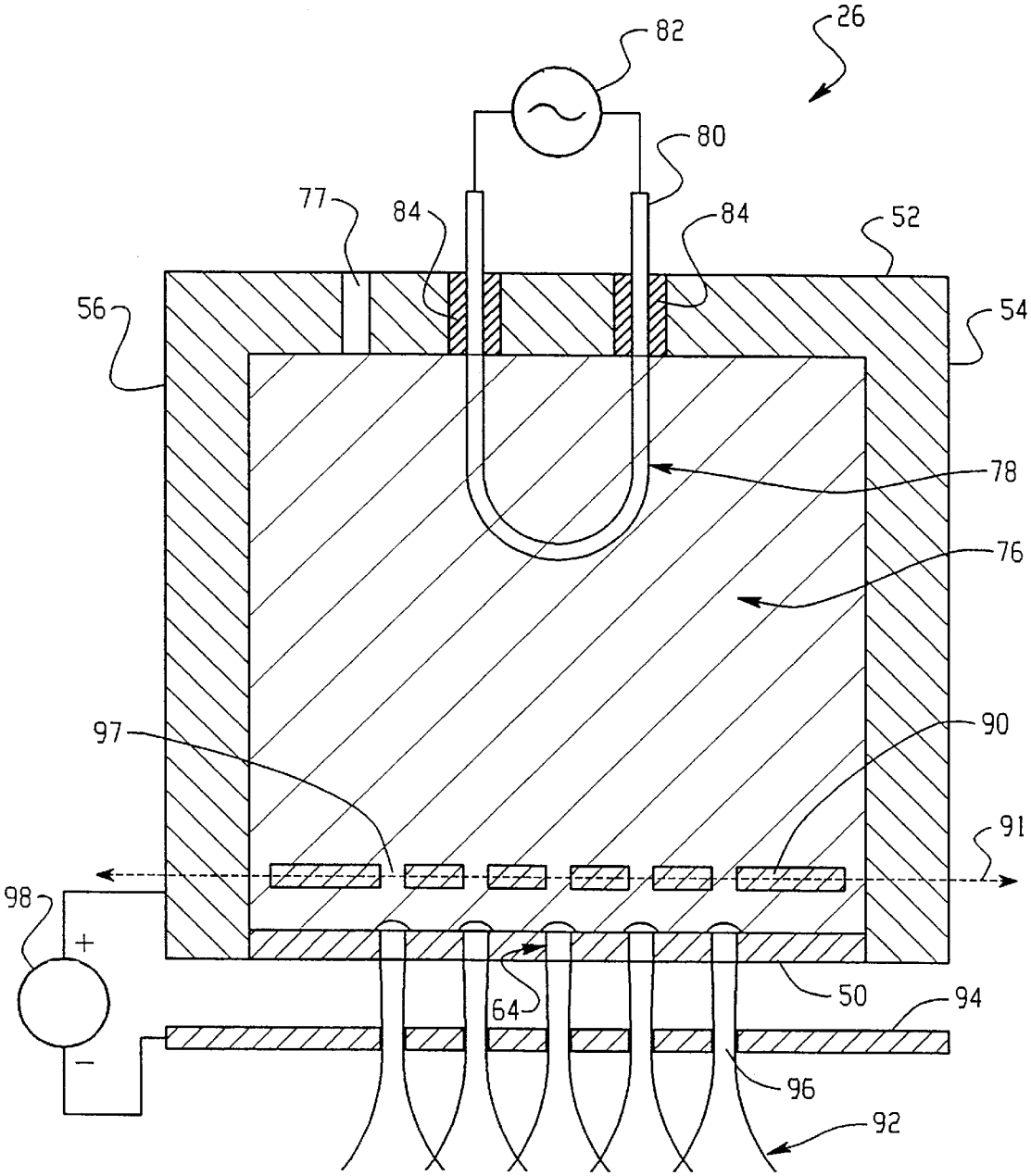
FIG. 3 is a side cross sectional view of the ion source of FIG. 2, taken along the lines 3—3 of FIG. 2.

As shown in FIG. 3, the walls of the ion source form the chamber 76 in which plasma is generated in the following manner. As is known in the art, source gas is introduced into the chamber 76 through an inlet 77 and ionized by at least one coil shaped filament or exciter 78 which is electrically excited through electrical leads 80 by voltage source 82. Insulators 84 electrically isolate the exciter 78 from the back wall 52 of the ion source 26. The exciters are each comprised of a tungsten filament which when heated to a suitable temperature thermionically emits electrons. Ionizing electrons may also be generated by using radio frequency (RF) excitation means, such as an RF antenna. The electrons interact with and ionize the source gas to form a plasma within the plasma chamber. An example of a source gas, which is ionized in the chamber 76, is diborane ($B_2H_6$) or phosphine ($PH_3$) that is diluted with hydrogen (H).

According to the present invention, an adjustable shutter or attenuator 90 (shown in the open position in FIG. 3) is disposed between the exciter 78 in the plasma chamber 76 and the plasma electrode 50, the purpose of which is further explained below. Ions are extracted from the plasma chamber 76 through apertures 97 in the attenuator 90 (which moves bi-directionally along axis 91) and through the plasma electrode 50 to form an ion beam 92. In the open position shown, the apertures 97 in the attenuator 90 are aligned with and at least as large as the apertures 64 in the plasma electrode 50. Thus, the attenuator does not obstruct the plasma flow or the resulting ion beam formation. In the closed or partially closed positions however, the apertures 97 do not align with apertures 64, effectively narrowing the plasma path and lowering the ion density in the resulting ion beam. Any number of patterns of apertures 64 and 97 are contemplated by the present invention. The function of the attenuator remains the same, however, in controlling the mechanical transparency of the plasma electrode apertures 64.

Figure 4:
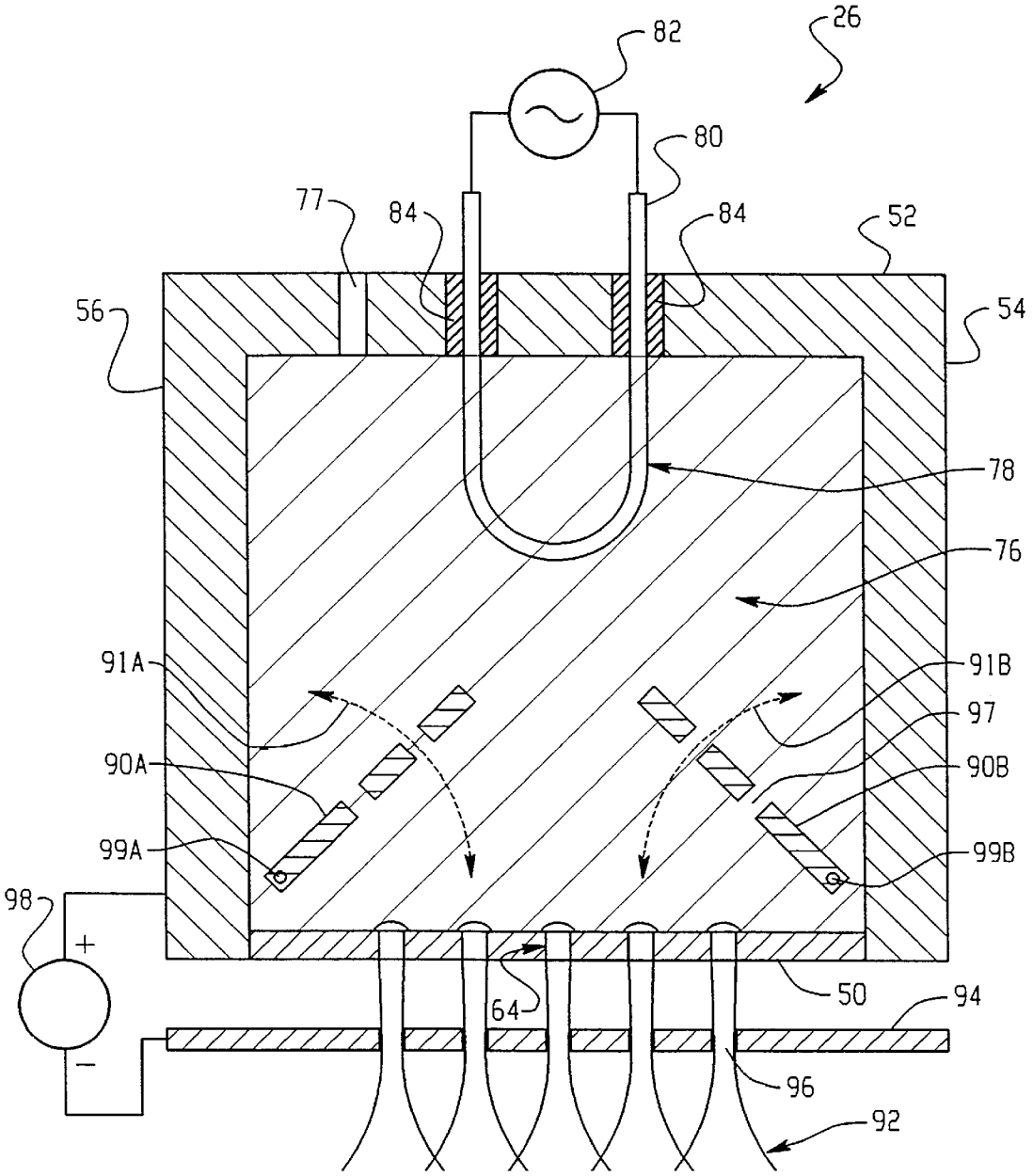
FIG. 4 is a side cross sectional view of an alternative embodiment of the ion source of FIG. 2, taken along the lines 3—3 of FIG. 2.

FIG. 4 shows an alternative embodiment of the attenuator 90 which comprises two portions 90A and 90B which open and close by pivoting about pivot points 99A and 99B, respectively. Accordingly, the attenuator portions 90A and 90B move bi-directionally along arc-shaped paths 91A and 91B, respectively. FIG. 4 shows the attenuator 90 in an open position. In the closed position, the attenuator portions 90A and 90B would pivot downward about points 99A and 99B, respectively.

The attenuator 90 shown in FIGS. 3 or 4 is intended to be constructed in either of two configurations. In a first configuration, the attenuator 90 in the closed position lies adjacent the plasma electrode 50, with little or no space therebetween. Movement of the attenuator between the open and closed positions merely alters the mechanical transparency of the plasma electrode apertures 64. In the open position, the apertures 64 are unobstructed by the attenuator, while in the closed or partially closed positions the apertures 64 are partially obstructed by the attenuator, effectively attenuating the resulting ion beam intensity.

An extractor electrode 94 located outside the plasma chamber 76 extracts the ions through the elongated apertures 64 in the plasma electrode and corresponding apertures 96 in the extractor electrode 94, as is known in the art. A voltage differential between the plasma and extractor electrodes, which is necessary for ion extraction, is provided by voltage source 98, which operates on the order of 0.5 to 10 kilovolts (kV). The voltage potential of the extractor electrodes 94 is less than that of the plasma electrode 50. The extracted ion beam 84 is then directed toward the target panel.

Figure 5:
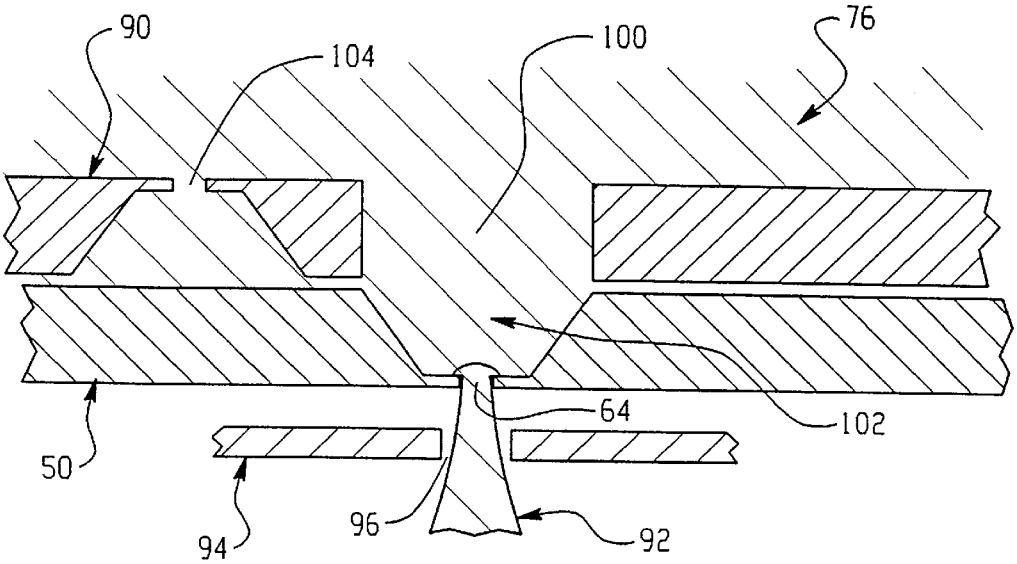
FIGS. 5 and 6 are expanded cross sectional views of a portion of the ion source of FIG. 3, showing the adjustable attenuator of the ion source in open and closed positions, respectively.
Figure 6:
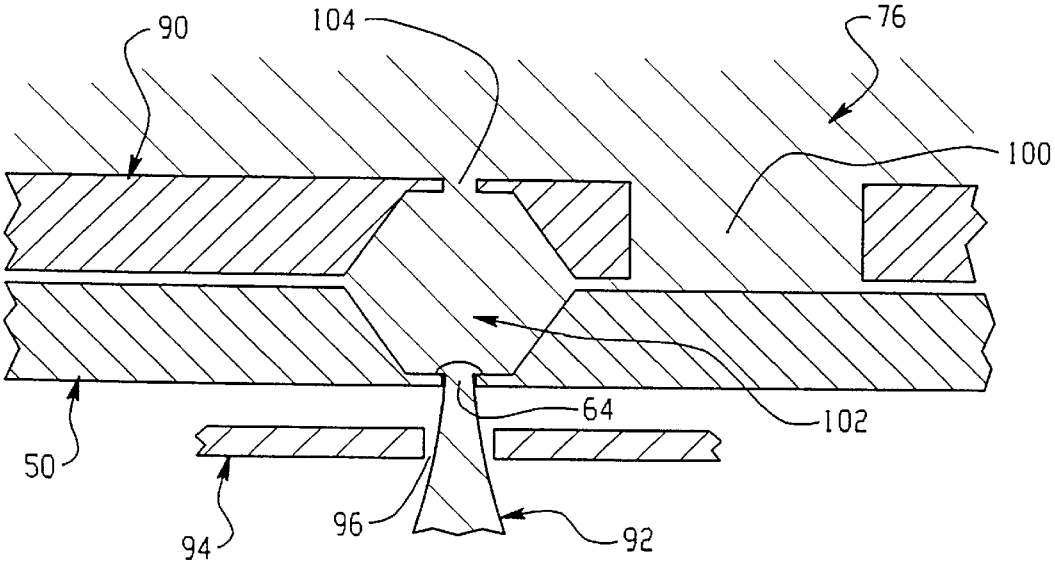

FIGS. 5 and 6 show the second configuration of the adjustable attenuator 90 of the ion source 26 in greater detail. FIG. 5 shows the attenuator 90 in an open position. In this position, ions in the high-density plasma generated within plasma chamber 76 are extracted through the apertures 64 in the plasma electrode, unimpeded by the attenuator. In the open position, apertures 100 in the attenuator 90 are at least as large as the apertures 64 in the plasma electrode 50. A region 102, located between apertures 100 in the attenuator 90 and apertures 64 in the plasma electrode 50, is continuous with chamber 76, and thus contains plasma of the same density as that which occupies chamber 76. Accordingly, the ion beam 92 output by the ion source is a high current beam.

FIG. 6 shows the attenuator 90 in a closed position. In this position, the passage of high density plasma from plasma chamber 76 to region 102 is partially impeded by apertures 104 in the attenuator, which are smaller than apertures 100. The region 102 is a generally closed cavity bounded by the attenuator 90 and the plasma electrode 50. Accordingly, the plasma diffuses from the region of high density in the plasma chamber 76 through the apertures 104, the diffusion process weakening the plasma by lowering the density thereof. Thus region 102, located between apertures 104 in the attenuator 90 and apertures 64 in the plasma electrode 50, contains plasma of a lower density than that which occupies chamber 76. For example, the plasma in region 102 may be on the order of $10^{-2}$ (1%) of the density of the plasma in chamber 76. By providing a region of lower plasma density between apertures 64 and 104, the plasma diffuses through the attenuator 90, improving the spatial uniformity of the extracted ion beam and increasing the degree of beam power attenuation.

Accordingly, for a given plasma density in plasma chamber 76 and a given input power applied to the exciter 78, the ion beam 92 output by the ion source in FIG. 6 (with the attenuator closed) is a lower current beam than that output by the ion source in FIG. 5 (with the attenuator open). However, because the input power to the exciter is not changed, the beam constituency, in terms of relative quantities of ion species, remains largely unaffected in both the low current (FIG. 6) and high current (FIG. 5) conditions.

The attenuator shown in FIGS. 5 and 6 is slidable along the plane of the plasma electrode 50. Movement of the attenuator may be accomplished either manually or by automatic means as part of a control system. The degree of attenuation of the ion beam may also be affected by varying the position of the attenuator within the plasma chamber. As such, a positioning mechanism may be provided to enable repositioning of the attenuator toward and away from the plasma electrode 50.

Figure 7:
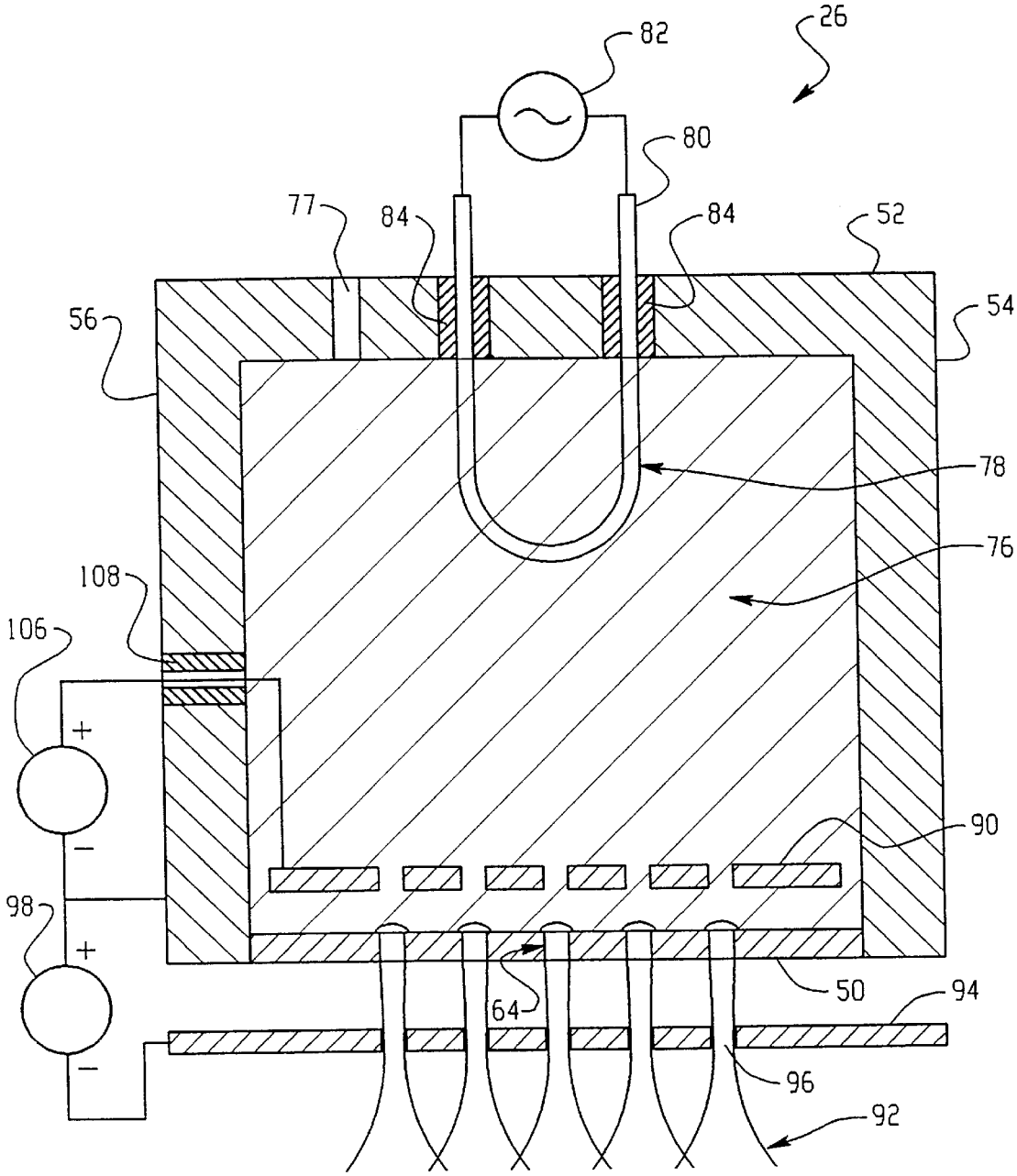
FIG. 7 is a side cross sectional view of another embodiment of the present invention which includes a voltage source for the attenuator.

FIG. 7 shows a second embodiment of the present invention, where a voltage source 106 is provided for electrically biasing the attenuator 90 with respect to the plasma electrode 50. Insulator 108 isolates electrical connections between the attenuator and the voltage source from the bottom wall 56. Adjusting the bias voltage applied to the attenuator is used to control the degree of attenuation provided by the attenuator and the relative quantities of the species that make up of the ion beam. Voltage source 106 typically operates in the range of +\−2 kilovolts (kV), and may be biased either positively or negatively with respect to the plasma electrode 50.

Figure 8:
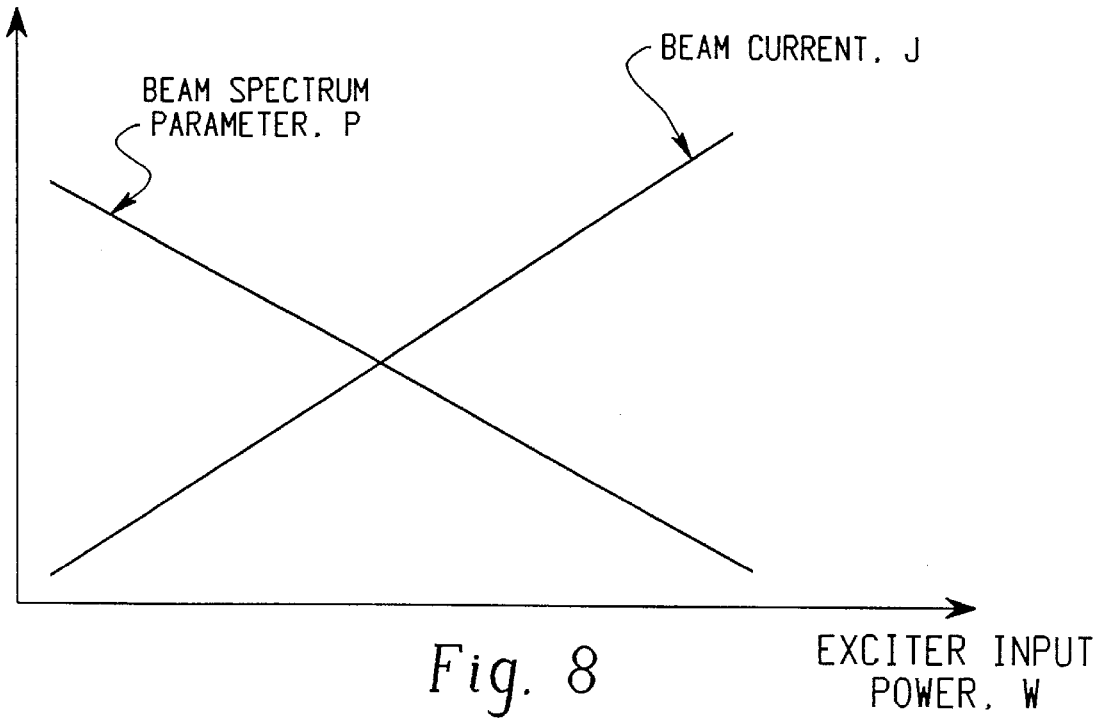
Fig. 8 (PRIOR ART)
FIGS. 8 and 9 are graphical representations of prior art ion source operating characteristics.

FIGS. 8 through 11 graphically illustrate the improved current operating regions provided by the present invention over known ion sources. As shown in FIG. 8, using known ion sources without the inventive attenuator provided by the present invention, ion beam current J and a particular beam spectrum parameter P (such as a portion of the ion beam comprised by a particular atomic or molecular species) are plotted against exciter input power W. Both beam current J and parameter P are dependent upon exciter input power W.

Figure 9:
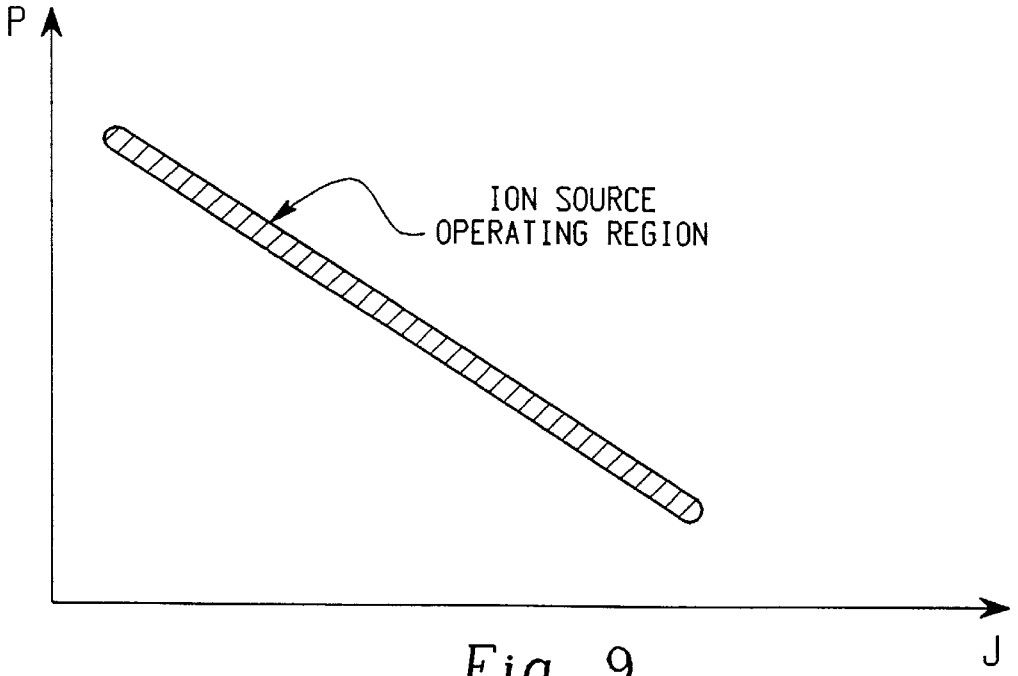
Fig. 9 (PRIOR ART)

Accordingly, for a given input power W, a desired beam current J is necessarily coupled to a particular value of parameter P, and similarly, a desired parameter P is necessarily coupled to a particular value of beam current J. Thus, as shown in FIG. 9, when beam current J is plotted graphically against parameter P, the ion source operating region is a narrow one-dimensional region. Both J and P are functions of the exciter input power W which cannot be varied independently of the exciter input power.

Figure 10:
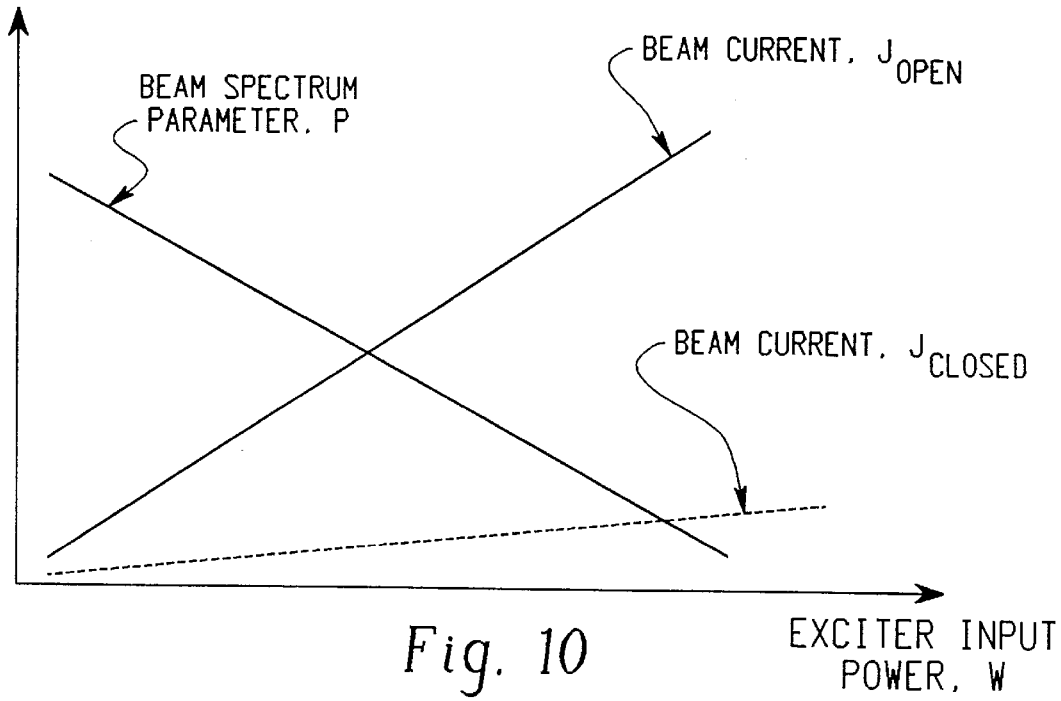
FIGS. 10 and 11 are graphical representations of the operating characteristics of the ion source of the present invention.

Using the ion source of the present invention, however, the ion beam current J may be varied independently of the exciter input power W and parameter P. Although a particular beam current J remains dependent upon both W and P, that particular beam current is made adjustable, for a given value combination of exciter input power W and parameter P, by the position of the dual position attenuator 90. As shown in FIG. 10, ion beam current is higher ($J_{open}$, solid line) when the attenuator 90 is in the open position corresponding to FIG. 5, and is lower ($J_{closed}$, dashed line) when the attenuator 90 is in the closed position corresponding to FIG. 6.

Figure 11:
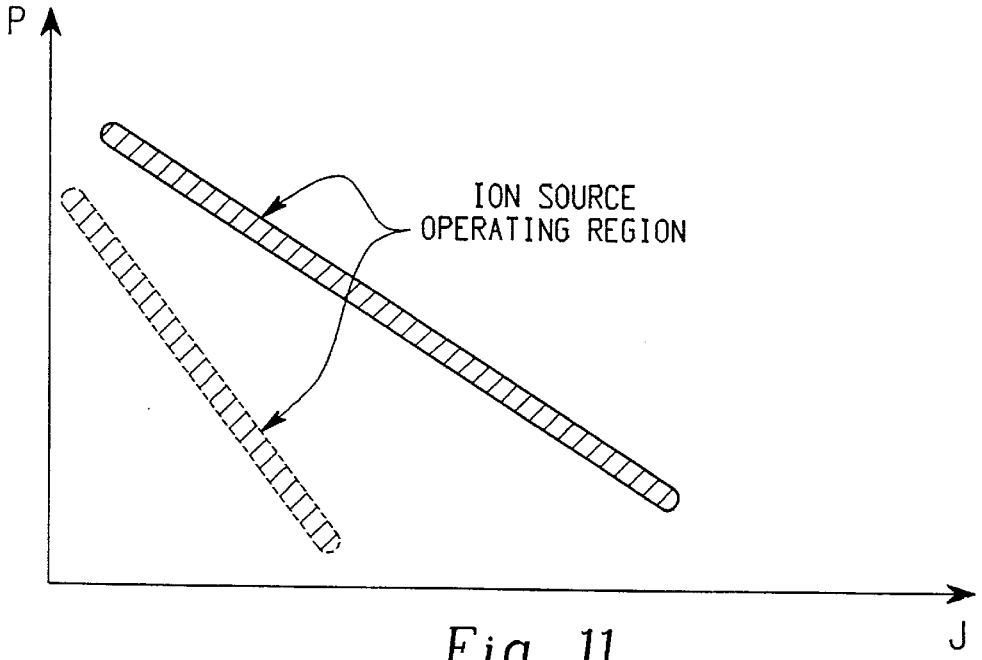

Thus, a desired beam current J is not necessarily coupled to a particular value of parameter P, and similarly, a desired parameter P is not necessarily coupled to a particular value of beam current J. Thus, as shown in FIG. 11, when beam currents $J_{open}$ and $J_{closed}$ are plotted graphically against parameter P, the ion source operating region is now larger consisting of two narrow one-dimensional regions. Ion beam current J may now be varied independently of both exciter input power W and parameter P.

The attenuator 90 in FIGS. 5 and 6 may be provided with more than two sized apertures 100 and 104. For example, the attenuator may be provided with apertures having one or more sizes between the sizes of apertures 100 and 104. In such a case, linear beam current functions and operating regions between those shown in FIGS. 10 and 11, respectively, may be obtained. In this manner, a number of discrete operating modes for the ion source are provided. By providing a sufficient number of sizes of apertures, the ion source operating region shown in FIG. 11 could effectively cover the entire area between the two narrow linear regions shown.

Alternatively, a series of apertures may be provided having sizes which are infinitely variable between completely open and completely closed positions. An attenuator having such variably sized openings may be operated by a control system, such as a servomechanism, which receives operating conditions as inputs and controls the size of the aperture in response thereto. Again, such a system would provide for an ion source operating region that would include the entire area between the two narrow linear regions shown in FIG. 11, providing a wide infinitely-adjustable dynamic range of ion beam currents which are selectable independent of parameters such as the particular atomic or molecular species constituting the beam.

Accordingly, a preferred embodiment of an attenuator for an ion source has been described. With the foregoing description in mind, however, it is understood that this description is made only by way of example, that the invention is not limited to the particular embodiments described herein, and that various rearrangements, modifications, and substitutions may be implemented with respect to the foregoing description without departing from the scope of the invention as defined by the following claims and their equivalents.

What is claimed is:

1. An attenuator (90) for an ion source (26), the ion source comprising a plasma chamber (76) in which a gas is ionized by an exciter (78) to create a plasma which is extractable through at least one aperture (64) in an aperture plate (50) of said chamber to form an ion beam, said attenuator (90) comprising:

a member (90) positioned within said chamber (76) intermediate said exciter (78) and said at least one aperture (64), said member providing at least one first opening (97) corresponding said at least one aperture (64), said member being moveable between first and second positions with respect to said at least one aperture, wherein said member and said aperture plate form a generally closed region (102) therebetween when said member is in said first position, and wherein said aperture (64) is in direct communication with said chamber (76) when said member is in said second position, such that in said first position plasma within said chamber (76) diffuses through said region (102) and is extracted through said aperture and in said second position plasma within said chamber is extracted directly through said aperture.

2. The ion source attenuator (90) of claim 1, wherein said member is moveable from (i) said first position wherein said member is positioned adjacent said aperture (64) to obstruct at least a portion of said aperture to (ii) said second position wherein said member is positioned away from said aperture (64) so as not to obstruct said aperture.

3. The ion source attenuator (90) of claim 2, wherein said member moves between said first and second positions by sliding in a direction which is parallel to the plane of said aperture plate.

4. The ion source attenuator (90) of claim 2, wherein said member (90) comprises two portions (90A, 90B) which move between said first and second positions by pivoting toward and away from said aperture plate (50), respectively.

5. The ion source attenuator (90) of claim 2, wherein said member is provided with first and second openings (104, 100) corresponding to said first and second positions, said second opening (100) being larger in size than said first opening (104).

6. The ion source attenuator (90) of claim 5, wherein said first and second openings (104, 100) in said member are formed by a single variable opening the size of which is made variable.

7. The ion source attenuator (90) of claim 6, wherein the size of said single variable opening is made infinitely variable to provide for an infinite number of modes of operation of said ion source, the size of said single variable opening being determined by a control system which receives ion source operating conditions as inputs and controls the size of the single variable opening in response thereto.

8. The ion source attenuator (90) of claim 2, wherein said member is electrically biased with respect to said chamber aperture.

9. The ion source attenuator (90) of claim 1, wherein plasma contained within said generally closed region (102) is of lesser density than the plasma contained within said plasma chamber (76).

10. An ion source (26), comprising:

a plasma chamber (76) in which a gas is ionized by an exciter (78) to create a plasma which is extractable through at least one aperture (64) in an aperture plate (50) of said chamber to form an ion beam, said attenuator (90) comprising:

a member (90) positioned within said chamber (76) intermediate said exciter (78) and said at least one aperture (64), said member providing at least one first opening (97) corresponding said at least one aperture (64), said member being moveable between first and second positions with respect to said at least one aperture, wherein said member and said aperture plate form a generally closed region (102) therebetween when said member is in said first position, and wherein said aperture (64) is in direct communication with said chamber when said member is in said second position, such that in said first position plasma within said chamber (76) diffuses through said region (102) and is extracted through said aperture and in said second position plasma within said chamber is extracted directly through said aperture.

11. The ion source (26) of claim 10, wherein said member is moveable from (i) said first position wherein said member is positioned adjacent said aperture (64) to obstruct at least a portion of said aperture to (ii) said second position wherein said member is positioned away from said aperture (64) so as not to obstruct said aperture.

12. The ion source (26) of claim 11, wherein said member moves between said first and second positions by sliding in a direction which is parallel to the plane of said aperture plate.

13. The ion source (26) of claim 11, wherein said member (90) comprises two portions (90A, 90B) which move between said first and second positions by pivoting toward and away from said aperture plate (50), respectively.

14. The ion source (26) of claim 10, wherein plasma contained within said generally closed region (102) is of lesser density than the plasma contained within said plasma chamber (76).

15. The ion source (26) of claim 11, wherein said member is provided with first and second openings (104, 100) corresponding to said first and second positions, said second opening (100) being larger in size than said first opening (104).

16. The ion source (26) of claim 15, wherein said first and second openings (104, 100) in said member are formed by a single variable opening the size of which is made variable.

17. The ion source (26) of claim 16, wherein the size of said single variable opening is made infinitely variable to provide for an infinite number of modes of operation of said ion source, the size of said single variable opening being determined by a control system which receives ion source operating conditions as inputs and controls the size of the single variable opening in response thereto.

18. The ion source (26) of claim 11, wherein said member is electrically biased with respect to said chamber aperture.

* * * * *